US009976727B2

(12) United States Patent
White et al.

(10) Patent No.: US 9,976,727 B2
(45) Date of Patent: May 22, 2018

(54) STRIP LIGHT ARRANGEMENT FOR T BAR CEILING GRID SYSTEMS

(71) Applicant: CERTAINTEED CANADA, INC., Toronto (CA)

(72) Inventors: Ronald White, Holland Landing (CA); Martin D. Gerkes, Toronto (CA)

(73) Assignee: CertainTeed Canada, Inc., Toronto, Ontario (CA)

( * ) Notice: Subject to any disclaimer, the term of this patent is extended or adjusted under 35 U.S.C. 154(b) by 142 days.

(21) Appl. No.: 14/827,908

(22) Filed: Aug. 17, 2015

(65) Prior Publication Data

US 2016/0061395 A1 Mar. 3, 2016

(30) Foreign Application Priority Data

Aug. 29, 2014 (CA) ..... 2861363

(51) Int. Cl.

| | |
|---|---|
| ***F21V 21/002*** | (2006.01) |
| ***F21S 2/00*** | (2016.01) |
| ***E04B 9/00*** | (2006.01) |
| ***E04B 9/12*** | (2006.01) |
| ***F21S 4/20*** | (2016.01) |
| *F21V 21/088* | (2006.01) |
| *F21V 21/04* | (2006.01) |
| *F21S 4/28* | (2016.01) |
| *F21Y 115/10* | (2016.01) |

(52) U.S. Cl.

CPC ..... *F21V 21/002* (2013.01); *E04B 9/006* (2013.01); *E04B 9/122* (2013.01); *F21S 2/00* (2013.01); *F21S 4/20* (2016.01); *F21S 4/28* (2016.01); *F21V 21/048* (2013.01); *F21V 21/088* (2013.01); *F21Y 2115/10* (2016.08)

(58) Field of Classification Search

CPC .... F24F 3/056; F21S 2/00; F21S 2/005; F21S 4/20; F21S 4/28; F21S 8/043–8/06; F21S 8/066; F21V 31/34; F21V 31/35; F21V 21/002; F21V 21/025; F21V 21/088; H01R 25/14–25/147; E04B 9/006; E04B 9/122; E04B 9/125

See application file for complete search history.

(56) References Cited

U.S. PATENT DOCUMENTS

| | | | |
|---|---|---|---|
| 3,685,235 | A | 8/1972 | Lang |
| 4,494,350 | A | 1/1985 | Sharp |
| 5,154,031 | A | 10/1992 | Wall |

(Continued)

FOREIGN PATENT DOCUMENTS

| | | | |
|---|---|---|---|
| CA | 2841180 | A1 | 1/2013 |
| CN | 202469680 | U | 10/2012 |

(Continued)

*Primary Examiner* — Anh Mai
*Assistant Examiner* — Steven Horikoshi
(74) *Attorney, Agent, or Firm* — McDonnell Boehnen Hulbert & Berghoff LLP

(57) ABSTRACT

A cross member of a T bar ceiling system is designed to be part of the ceiling grid system and adapted to releasably receive a strip light beneath the cross T member. The strip light provides support flanges beneath the T member for supporting a ceiling panel edge at the conventional height. With this arrangement the grid system can be installed in the normal manner with these cross T's at positions where strip lights are to be secured. The strip lights can be installed at a later point in time. Preferably a push type releasable connection is used.

12 Claims, 7 Drawing Sheets

(56) References Cited

U.S. PATENT DOCUMENTS

| | | | |
|---|---|---|---|
| 8,177,385 | B2 | 5/2012 | Porciatti |
| 2004/0213003 | A1 | 10/2004 | Lauderdale et al. |
| 2006/0262521 | A1 | 11/2006 | Piepgras et al. |
| 2011/0286207 | A1 | 11/2011 | Chan |
| 2013/0039052 | A1 | 2/2013 | Forteza et al. |
| 2013/0083514 | A1 | 4/2013 | Wong et al. |
| 2013/0088890 | A1 | 4/2013 | Knapp |
| 2013/0182422 | A1 | 7/2013 | Guilmette |

FOREIGN PATENT DOCUMENTS

| | | | |
|---|---|---|---|
| CN | 203836724 | U | 9/2014 |
| CN | 204164871 | U | 2/2015 |

STRIP LIGHT ARRANGEMENT FOR T BAR CEILING GRID SYSTEMS

FIELD OF THE INVENTION

The present invention is with respect to strip lighting designed as part of a ceiling grid system.

BACKGROUND OF THE INVENTION

Strip lighting such as LED lighting and other low voltage light sources have been incorporated into suspension systems of a grid network of a ceiling panel suspension system. In one arrangement the strip light assembly is an LED strip light, with the light, housing being an actual cross member of a T bar grid system. With this system strip lighting can be provided at any of the cross members of a ceiling grid system however the strip light is installed as part of the actual grid system. This is in contrast to the well accepted practice of ceiling grid systems being installed by a first group of contractors and lighting associated with the ceiling system is installed by electricians either before the grid system is installed, after the grid system is installed, or as the grid system is being installed.

By having the strip light part of the actual ceiling grid system, difficulties can be encountered, particularly on large commercial projects where different union greens are represented. In addition, it is desirable to have the ceiling grid system as a single contract separate and apart from the lighting contract.

It has also been proposed to merely provide strip lighting which is directly suspended below the grid members at a desired position after the grid system is installed. This type of arrangement often requires modification of the panels, and access to the area above the finished ceiling may be more difficult.

The present invention provides an alternative to these practices and allows the installation of the ceiling grid system to be completed in a manner that strip lighting can be provided at predetermined locations after the grid network has been installed.

SUMMARY OF THE INVENTION

A cross member of a T bar ceiling grid system according to the present invention comprises bayonet type fasteners at opposite ends of the cross component with an elongate bridging member extending between the bayonet fasteners and spaced to an upper side of the bayonet fasteners. The elongate bridging component includes a pair of opposed side walls defining a downwardly opening aligning slot therebetween and a connection head above and joined to the sidewalls.

In an aspect of the invention, the side walls include longitudinal extending ribs on the exterior surface thereof for engaging and retaining spring clips of a light strip arrangement.

In a preferred aspect of the invention a bottom edge of the side walls is above a midpoint in height of the bayonet type fasteners.

In yet a further aspect of the invention the connection head includes a series of heat distribution fins extending outwardly therefrom. Preferably, the elongate bridging member is of an extruded cross section throughout a length thereof.

In an aspect of the invention, the cross member is used in combination with a strip light adapted to releasably engage and be supported from the cross member. The strip light includes a housing having on a top surface a securing flange extending upwardly and extending in a length of the housing. The securing flange is of a size for edge insertion between the pair of opposed side walls of the cross member. Releasable fastening members secure the strip light to the cross member.

In an aspect of the invention, the fastening members are releasable spring clips secured to the securing flange and positioned to engage the side walls to secure the strip light to the cross member when the securing flange is inserted between the side walls. Preferably she releasable spring clips are secured on opposite sides of the securing flange and engage securing ribs provided on outside facing surfaces of the side walls.

In yet a further aspect of the combination, the securing flange is positioned intermediate the length of the housing to generally extend between the bayonet type fasteners such that the bayonet type fasteners are located beyond the ends of the securing flange when the strip light is connected to the cross member.

In a preferred aspect of the combination, the housing includes a series of ribs extending in the length and provided either end of the housing for receiving and engaging a bottom edge of the bayonet type fasteners when the strip light is supported by the cross member. Preferably, the bayonet type fasteners are partially received in the downwardly aligning slot and secured to the side walls such that the bayonet type fasteners extend outwardly from opposed ends of the elongate bridging member.

Preferably, the bayonet type fasteners are positioned below the connection head of the bridging member.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
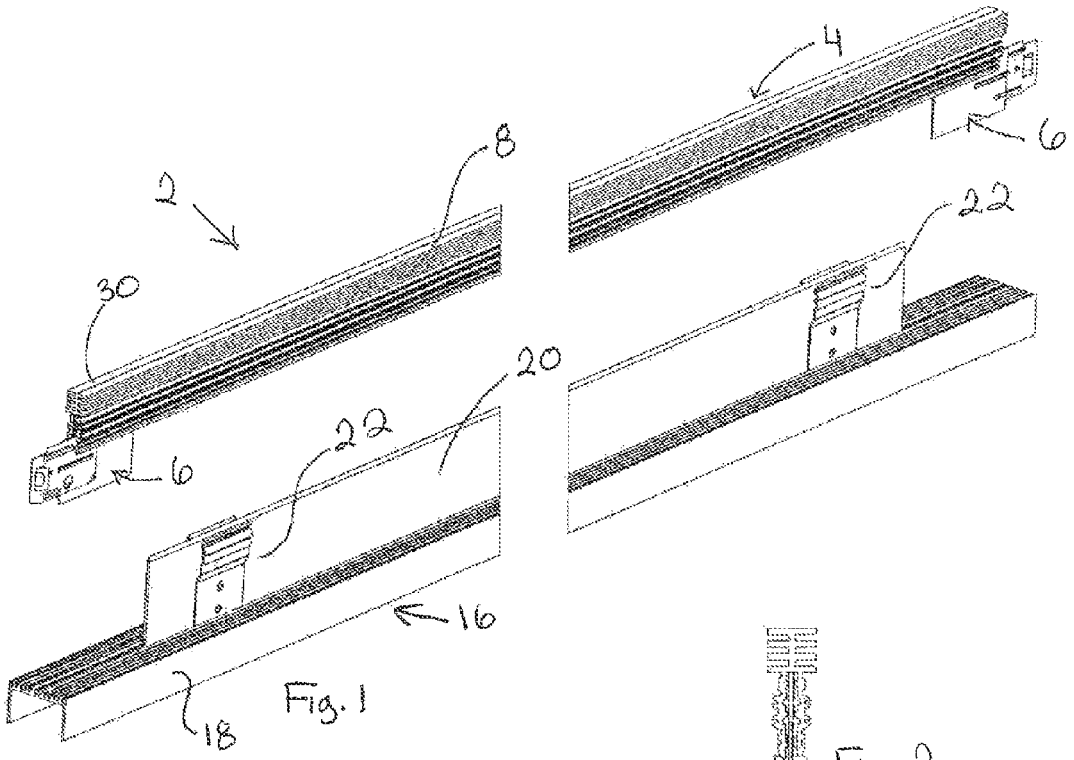
FIG. 1 is a perspective view of a strip light and a T bar supporting member before securement.

FIG. 1 shows a strip light assembly 2, in this case designed for a T bar ceiling paneling system. The strip light assembly is made up of a T bar member 4 shown as a cross T of a T bar suspension system. T bar connectors 6 are provided at opposite ends of the T bar member. The connectors 6 extend downwardly from the raised elongate connecting member 8. Preferably the raised elongate connecting member 8 is an extruded metal member having a finned thermal transfer head 30 designed to dissipate heat produced by the strip light housing arrangement 16 to the space above the grid system. The strip light housing arrangement 16 includes a series of low voltage light sources spaced in the length of the housing and the strip light is subsequently connected to a low voltage power supply typically mounted above the grid system.

The strip light housing arrangement 16 includes a light housing 18 of a 'U' shape or channel shape that opens in a downward direction. An insert projection 20 is provided on the top surface of the light housing 18 and is centered in the width of the light housing. A series of retaining springs 22 are provided on the insert projection and these spring clips cooperate to releasably attach the raised elongate connecting member 18 of the strip light assembly to the grid system.

Figure 2:
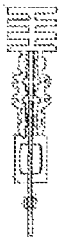
FIG. 2 is an end view of the T bar support member of FIG. 1.
Figure 3:
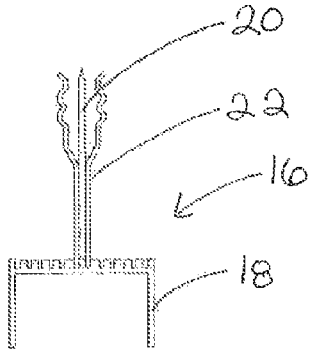
FIG. 3 is an end view of the strip light of FIG. 1.

FIG. 2 is an end view of T bar member 4 showing the T bar connectors and the raised elongate connecting member 8. FIG. 3 is a cross section of the strip light housing arrangement.

Figure 4:
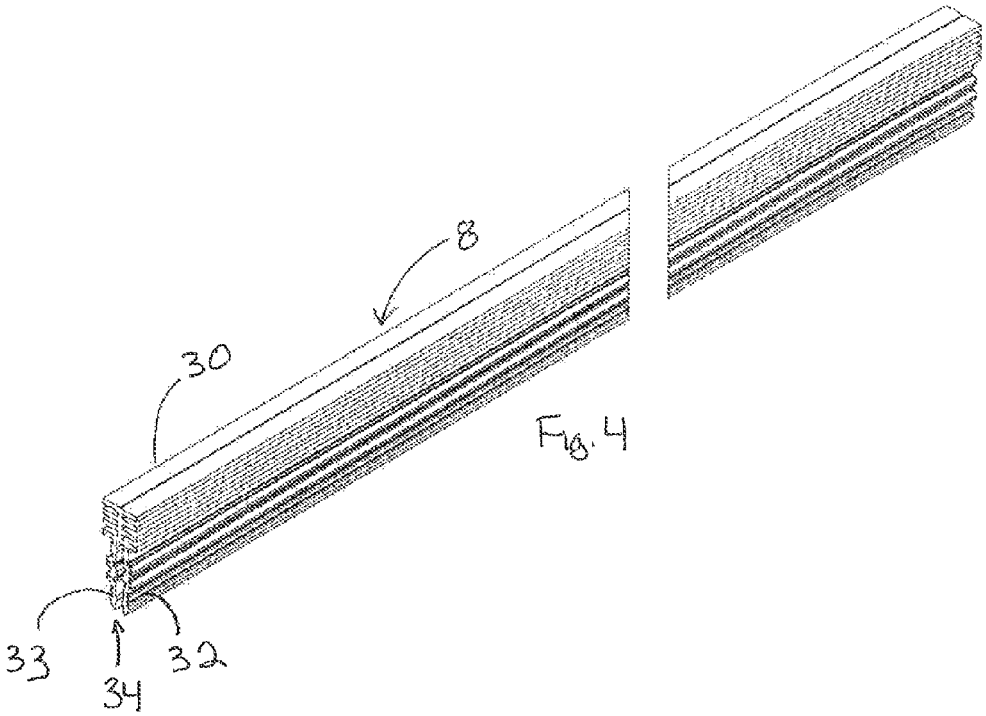
FIG. 4 is a perspective view of the elongate body member of the T bar support member of FIG. 1.
Figure 5:
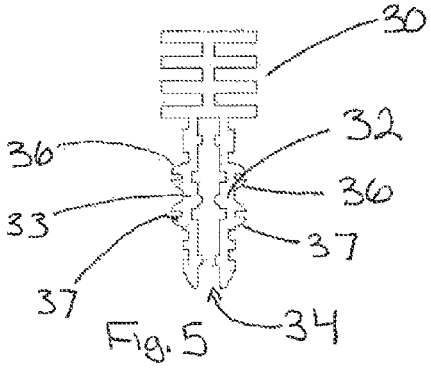
FIG. 5 is an end view of the elongate body member of FIG. 4.

FIGS. 4 and 5 show additional details of the raised elongate connecting member 8. The upper most portion of the raised connecting member 8 is defined by the finned thermal transfer head 30 which not only provides structural rigidity to the T bar member but also acts to dissipate heat that has been conducted to this member from the strip light housing arrangement 16. Below the fins thermal transfer head 30 are two downwardly extending stabilizing arms 32 and 33. A securing gap 34 is defined between these downwardly extending stabilizing arms as shown in FIG. 5. The downwardly extending stabilizing arms 32 and 33 each include outwardly facing upper and lower securing beads 36 and 37.

Figure 6:
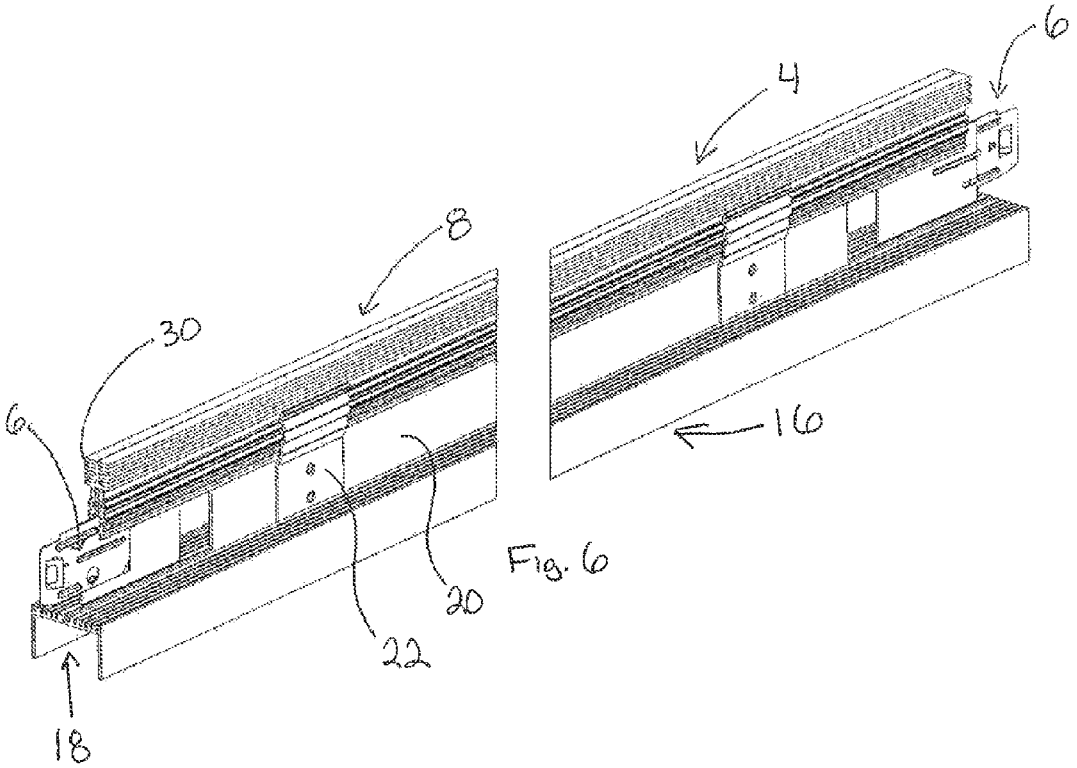
FIG. 6 is a perspective view of the strip light and T bar support member in a secured position.

The retaining spring clips 22 releasably interlock with these outwardly facing upper and lower securing beads 35 and 37 when the strip light housing arrangement has been moved into secure engagement with the T bar member 4. FIG. 6 illustrates the strip light housing 16 when secured to the T bar member 4. The sectional view is also shown in FIG. 7.

It can be seen that the insert projection 20 of the strip light housing arrangement 16 is received between the two downwardly extending stabilizing arms 32 and 33. The retaining spring clips 22 are provided to the exterior of the downwardly extending stabilizing arms and have recesses on the interior surface of the retaining spring clips to interlock with the outwardly facing upper and lower securing beads 36 and 37 of the T bar member 4.

The T bar connectors 6 when secured to the T bar member 4, project downwardly from the raised elongate connecting member. When the strip light housing arrangement 16 is brought into engagement with the T bar member, the T bar connectors 6 align and lock in a receiving slot on the upper surface of the strip light housing arrangement 16 as shown in FIG. 6. With this particular cooperation either end of the strip light housing arrangement 16, the strip light housing arrangement is securely mounted to the raised elongate connecting member 8 due to the insert projection 20 being received in two arms as well as the downwardly extending T bar connectors 6 engaging a locating recess on the upper surface of the light housing 18. With this interaction of the T bar connector 6 with the upper surface of the light housing 18, as well as the retaining spring clips engaging the upper and lower securing beads 36 and 37, and the interaction due to the insert projection 20 being tightly received in the securing gap 34 of the T bar member, the strip light housing arrangement is releasably fixed to the T bar member 4.

Figure 7:
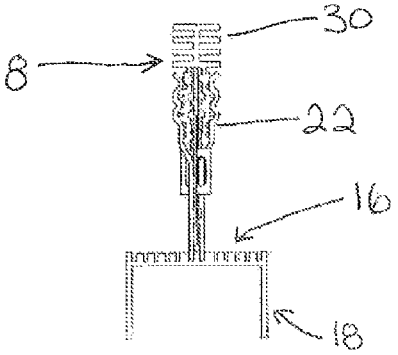
FIG. 7 is an end view of the structure shown in FIG. 6.
Figure 8:
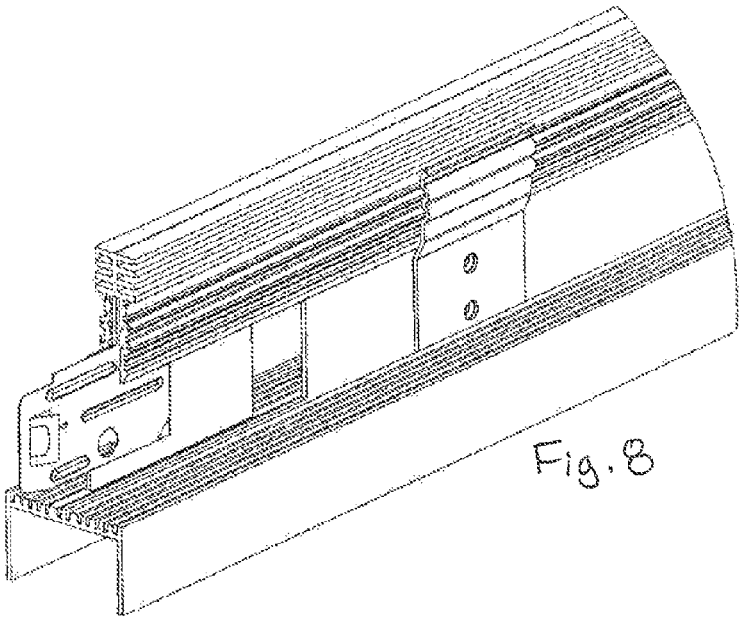
FIG. 8 is a partial perspective view of the secured strip light and T bar support member.
Figure 9:
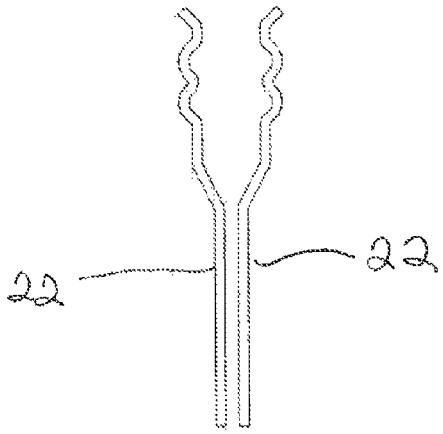
FIG. 9 shows details of two opposed spring clips.

Although the strip light housing arrangement 16 is shown in engagement with the T bar member 4 in FIGS. 6 and 7, it would normally be the case that the T bar member 4 which in this case is the cross member would be secured to adjacent grid members before the strip light housing arrangement 16 is secured beneath the T bar member. In this way the ceiling grid system can be installed and lighting subsequently secured. Details of this can be appreciated from FIGS. 10 and 11.

Figure 10:
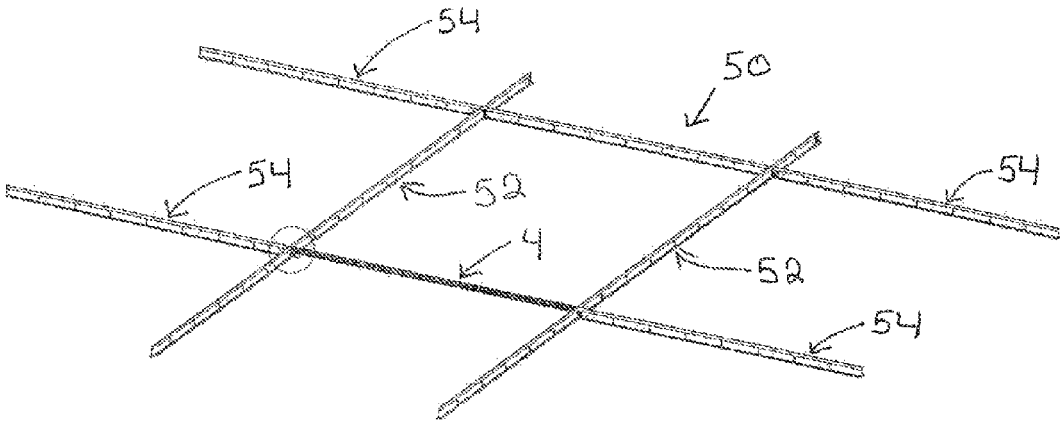
FIG. 10 is a partial perspective view of a grid system showing one T bar support for receiving a strip light.

A T bar grid system 50 is shown in FIG. 10 and comprises cross members 54 engaging main T members 52. FIG. 10 also shows how the T bar member 4 has replaced one of the cross members 54. The T bar member 4 is designed to engage the main T 52 in the conventional manner and is essentially a replacement for the cross member 54.

Figure 11:
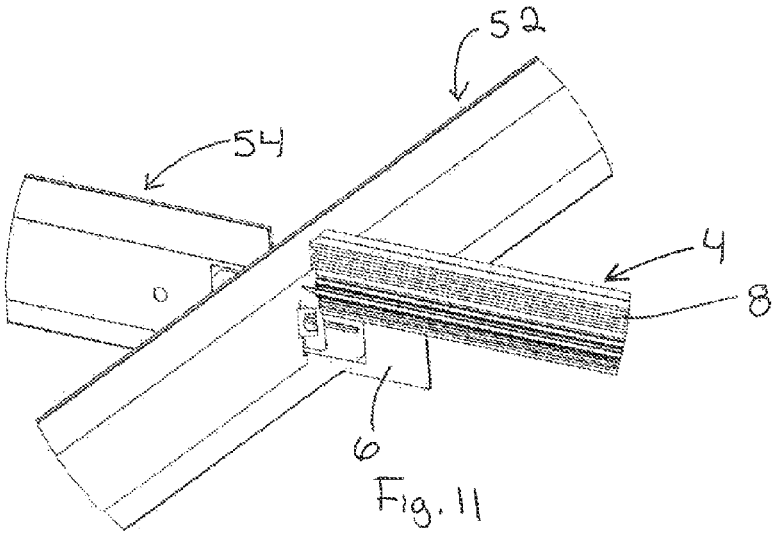
FIG. 11 is a partial perspective view of the connect of the one T bar support member to a main T bar member.
Figure 12:
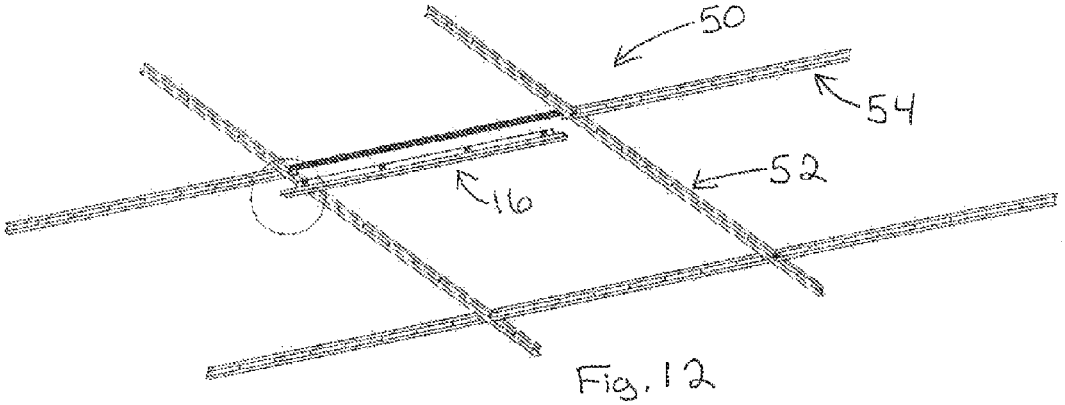
FIGS. 12 and 13 are similar to FIGS. 10 and 11 and additionally show a strip light about to be secured.

FIG. 11 shows a conventional cross member 54 with its own connector engaging the main T 52 and the T bar member 4 having its connector 6 engaging the main T 52. As shown, the raised elongate connecting member 8 is at a position substantially above the lower surface of a conventional cross T member 54. This additional elevation is to allow securement with the strip light housing as shown in FIGS. 12 and 13.

Figure 13:
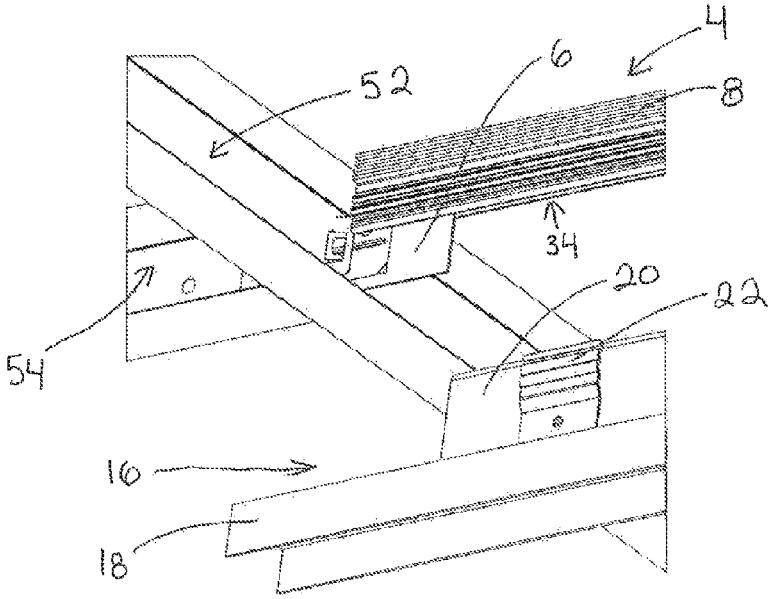

In FIG. 13 it can be seen that the strip light housing arrangement 16 is about to be moved upwardly into engagement with the raised elongate connecting member 8. Note that the insert projection 20 does not extend the full length of the light housing 18 as there must be room at the ends of the light housing 18 to allow the connectors 6 to engage the upper surface of the light housing. As previously described, the insert projection 20 is forced into the receiving gap 34 in the lower surface of the raised elongate connecting member 8 and the spring clips 211 will engage the upper and lower securing beads 36 and 37 of this member. With this arrangement, the T bar members 4 receive and retain the strip light housing arrangement 16 are provided at predetermined desired locations in the grid system 50. One such position is shown in FIG. 12.

Figure 14:
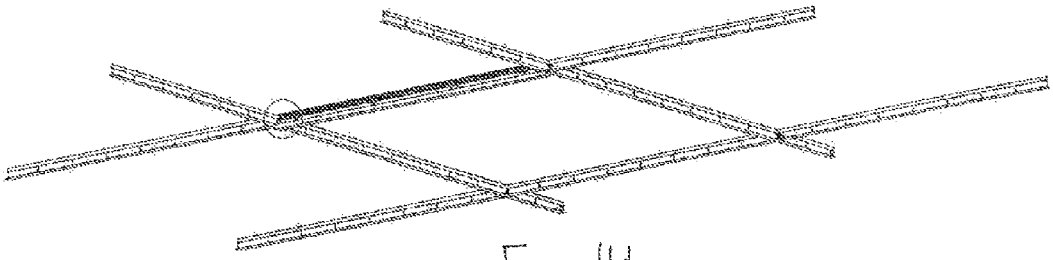
FIGS. 14 and 15 show the strip light of FIGS. 12 and 13 secured to the T bar member.
Figure 15:
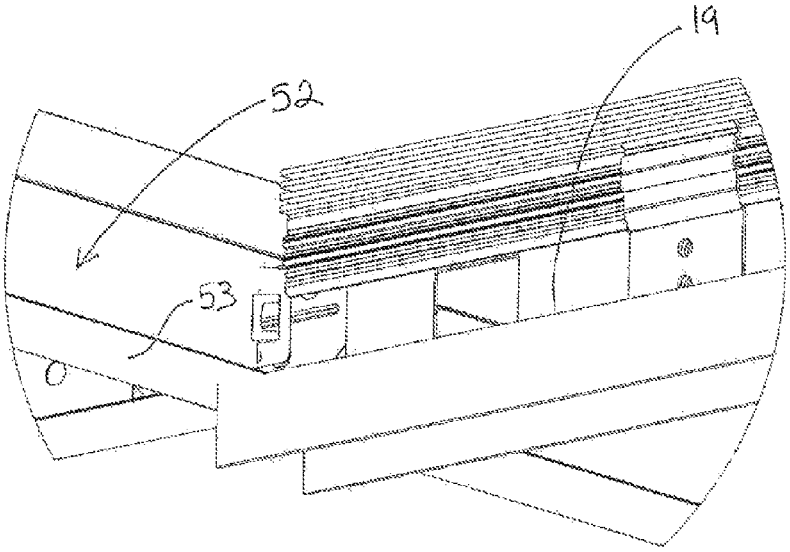

FIGS. 14 and 15 show the strip light housing arrangement when it is in engagement with the T bar member 4. The strip light housing arrangement 16 has the light housing 18 positioned below the lower surface 53 of the main T 52. The light housing 18 includes an upper projecting flange 19 which will support the ceiling panels when they are secured to the grid system. Thus the light housing 18 is positioned below the grid system and is aligned on the structural members of the grid system.

With the system as shown and described, the structural members defining the ceiling grid are installed without the strip light housing arrangement 16. The strip lights can be provided or left for the electrical contractor to install. Once the grid system is in place the electrical installer can then properly secure the low voltage power supplies and connect these to the electrical system. Typically the strip light housing arrangement 16 includes a simple snap in cable arrangement to electrically connect the low voltage supply to the strip lights.

With the present system installation is improved and the strip lighting is installed after the grid system is in place. The strip light housing engages a specialized T bar member, preferably a cross T bar member, and therefore the grid system does not include the strip light housing and the strip light is installed at a later point in time. The specialized T bar members use the same type of connecting clips or bayonets as are well known with existing T bar systems and any accepted connecting arrangement can be used. One such connecting member is shown but the type of connecting member can change, while the structural member cooperates with the strip light housing arrangement for support thereof.

The use of spring clips is particularly desirable as it simplifies the subsequent installation of the lights and has been found to provide positive releasable securement. If there are any problems with respect to the strip lights they can be easily removed yet they have excellent retention on the T bar members and meet the accepted provisions.

Although various preferred embodiments of the present invention have been described herein in detail, it will be appreciated by those skilled in the art, that variations may be made thereto without departing from the appended claims.

The embodiments of the invention in which an exclusive property or privilege is claimed are defined as follows:

1. A cross member of a T bar ceiling grid system comprising bayonet type fasteners at opposite ends of said cross member, an elongate bridging member extending between said bayonet type fasteners and spaced to an upper side of said bayonet type fasteners; said elongate bridging component including a pair of opposed side walls defining a downwardly opening aligning slot therebetween and a connection head above and joined to said sidewalls; and wherein a bottom edge of each side wall is located above a lower edge of said bayonet type fasteners.

2. A cross member of a T bar ceiling grid system as claimed in claim 1 wherein said side walls include longitudinal extending ribs on the exterior surface thereof for engaging and retaining spring clips of a light strip arrangement.

3. A cross member of a T bar ceiling grid system as claimed in claim 2 wherein the bottom edge of each side walls is above a midpoint in height of said bayonet type fasteners.

4. A cross member as claimed in claim 1 wherein said connection head includes a series of heat distribution fins extending outwardly therefrom.

5. A cross member as claimed in claim 2 wherein said elongate bridging member is of an extruded cross section throughout a length thereof.

6. In combination a cross member of a T bar ceiling grid system and a strip light adapted to releasably engage and be supported from said cross member; said cross member comprising bayonet type fasteners at opposite ends of said cross member, an elongate bridging member extending between said bayonet type fasteners with said bayonet type fasteners extending below a lower edge of said elongate bridging member; said elongate bridging member including a pair of opposed side walls defining a downwardly opening aligning slot therebetween and a connection head above and joined to said sidewalls; said strip light including a housing having on a top surface a securing flange extending upwardly and extending in a length of said housing, said securing flange being of a size for edge insertion between said pair of opposed side walls of said cross member; and releasable fastening members securing said strip light to said cross member.

7. In combination as claimed in claim 6, wherein said fastening members are releasable spring clips secured to said securing flange and positioned to engage said side walls to secure said strip light to said cross member when said securing flange is inserted between said side walls.

8. In combination as claimed in claim 7 wherein said releasable spring clips are secured on opposite sides of said securing flange and engage securing ribs integral with said side walls and provided on an exterior surface thereof.

9. In combination as claimed in claim 7 wherein said securing flange is positioned intermediate the length of said housing to generally extend between said bayonet type fasteners such that said bayonet type fasteners are located beyond the ends of said securing flange when said strip light is connected to said cross member.

10. In combination as claimed in claim 9 wherein said housing includes a series of ribs extending in the length and provided either end of said housing for receiving and engaging a bottom edge of said bayonet type fasteners when said strip light is supported by said cross member.

11. In combination as claimed in claim 10 wherein said bayonet type fasteners are partially received in said downwardly aligning slot and secured to said side walls such that said bayonet type fasteners extend outwardly from opposed ends of said elongate bridging member.

12. In combination as claimed in claim 11 wherein said bayonet type fasteners are positioned below said connection head of said bridging member.

* * * * *